US009099061B1

(12) United States Patent
Miyajima

(10) Patent No.: US 9,099,061 B1
(45) Date of Patent: Aug. 4, 2015

(54) DRUM STAND

(71) Applicant: HOSHINO GAKKI CO., LTD., Nagoya, Aichi (JP)

(72) Inventor: Hideyuki Miyajima, Nagoya (JP)

(73) Assignee: HOSINO GAKKI CO., LTD, Aichi (JP)

( * ) Notice: Subject to any disclaimer, the term of this patent is extended or adjusted under 35 U.S.C. 154(b) by 0 days.

(21) Appl. No.: 14/288,390

(22) Filed: May 28, 2014

(30) Foreign Application Priority Data

Feb. 27, 2014 (JP) ..... 2014-037273

(51) Int. Cl.
*G10D 13/02* (2006.01)

(52) U.S. Cl.
CPC ..... *G10D 13/026* (2013.01)

(58) Field of Classification Search
CPC ..... G10D 13/026
See application file for complete search history.

(56) References Cited

U.S. PATENT DOCUMENTS

| | | | | |
|---|---|---|---|---|
| 1,837,637 | A | 12/1931 | Walberg | |
| 2,245,883 | A * | 6/1941 | Walberg | 84/421 |
| 3,405,587 | A * | 10/1968 | Remo Meazzi et al. | 84/421 |
| 3,405,588 | A * | 10/1968 | Della-Porta | 84/421 |
| 5,467,680 | A * | 11/1995 | Kurosaki | 84/421 |
| 6,723,907 | B2 | 4/2004 | Sato | |
| 7,087,826 | B1 | 8/2006 | Lombardi | |
| 8,395,039 | B2 * | 3/2013 | Steinhauser et al. | 84/411 R |
| 2003/0126972 | A1 | 7/2003 | Sato | |
| 2003/0221540 | A1 * | 12/2003 | Takegawa | 84/421 |
| 2005/0103184 | A1 * | 5/2005 | Hsieh | 84/421 |
| 2007/0199429 | A1 * | 8/2007 | Hsieh | 84/422.1 |

FOREIGN PATENT DOCUMENTS

| | | | |
|---|---|---|---|
| JP | 2003-202859 | A | 7/2003 |
| WO | 2013/081960 | A1 | 6/2013 |

* cited by examiner

*Primary Examiner* — Robert W Horn

(57) ABSTRACT

The drum stand includes a stand main body, a drum support, and an attachment that attaches the drum support to the stand main body. The drum support is composed of a first arm and two second arms that open and close with respect to the first arm. The first and second arms all extend obliquely and linearly from near the upper end of a post toward a bottom surface of a snare drum.

10 Claims, 7 Drawing Sheets

DRUM STAND

BACKGROUND OF THE INVENTION

The present invention relates to a drum stand to be used when placing a drum on a floor.

This type of drum stand is disclosed in, for example, Japanese Laid-Open Patent Publication No. 2003-202859 and U.S. Pat. No. 1,837,637.

The drum stand disclosed in Japanese Published Unexamined Patent Application No. 2003-202859 includes a stand main body having a post and leg portions and a drum support that supports a snare drum. The drum support includes three arms, a drum supporting-side pipe extending downward from the center of three arms, three stays that couple the respective arms with the drum supporting-side pipe, and an adjusting nut screwed with the lower end of the drum supporting-side pipe. The three arms radially extend transversally from near the upper end of the drum supporting-side pipe. According to this arrangement, the adjusting nut is turned to raise the base ends of the stays along the drum supporting-side pipe together with an annular body. Because the three arms are thereby turned upward about the base ends of the respective arms, the diameter of a circle including the distal ends of the radially opened arm is reduced. That is, by operating the adjusting nut, the diameter of the drum support is adjusted to correspond to the snare drum diameter. Also, if there is a snare drum on the drum support, a lower hoop of the snare drum is grasped by the distal ends of the arms. In this case, the snare drum may also be lifted and moved together with the drum stand.

The drum stand disclosed in U.S. Pat. No. 1,837,637 also includes a stand main body having a post and leg portions and a drum support that supports a snare drum. The drum support includes a rectangular-shaped support plate and three arms radially extending transversally from the support plate. To the support plate, a first arm that is located at the center is attached to be slidable along the axis of the first arm. Also, to the support plate, two second arms are respectively pivotally coupled to open and close with respect to the first arm. According to this arrangement, by closing the second arms with respect to the first arm and then folding down the first and second arms along the post, the drum stand can be brought into a retracted form.

However, according to the drum stand disclosed in Japanese Laid-Open Patent Publication No. 2003-202859, with a support structure in which the base ends of the stays are raised along the drum supporting-side pipe together with the annular body, the snare drum can be supported only at relatively high positions. That is, the snare drum cannot be set at a low position, and in the case of supporting a snare drum having a large shell depth, the top head of the snare drum is likely to be located higher than a desired position. In contrast, the snare stand disclosed in U.S. Pat. No. 1,837,637 allows setting a snare drum at a position lower than that of the snare stand in Japanese Laid-Open Patent Publication No. 2003-202859. However, according to the drum stand disclosed in U.S. Pat. No. 1,837,637, it is necessary to provide a large space between the three arms and a bottom surface of the snare drum in order to avoid interference with the arms when the snare wires are loosened. Therefore, each arm is curved more greatly toward the distal end of the arm. Because of this arrangement, in a retracted form, the curved portions of the arms extend by a relatively great distance from the post of the stand main body near the distal end of the arms. That is, because the curved portions of the arms greatly project in a direction perpendicular to the post, the snare stand in a retracted state cannot be compact.

SUMMARY OF THE INVENTION

It is an object of the present invention to provide a drum stand that allows setting a drum at a low position, and allows making a retracted form compact.

In order to solve the foregoing problems, according to a first aspect of the present invention, a drum stand including a stand main body having a post and a drum support having a plurality of arms that support a drum, the plurality of arms being able to take an in-use form in which the arms are radially opened transversally from near an upper end of the post and a retracted form into which the arms turn transversally to be closed from the in-use form and are folded up along the post is provided. The plurality of arms consist of a first arm provided near an upper end of the post and a second arm provided near the upper end of the post, being transversally turnable to open and close with respect to the first arm, and the first and second arms respectively extend obliquely and linearly toward a bottom surface of the drum.

DETAILED DESCRIPTION OF THE PREFERRED EMBODIMENTS

Hereinafter, an embodiment for which a drum stand according to the present invention is embodied into a snare drum stand will be described with reference to FIG. 1 to FIG. 8.

Figure 1:
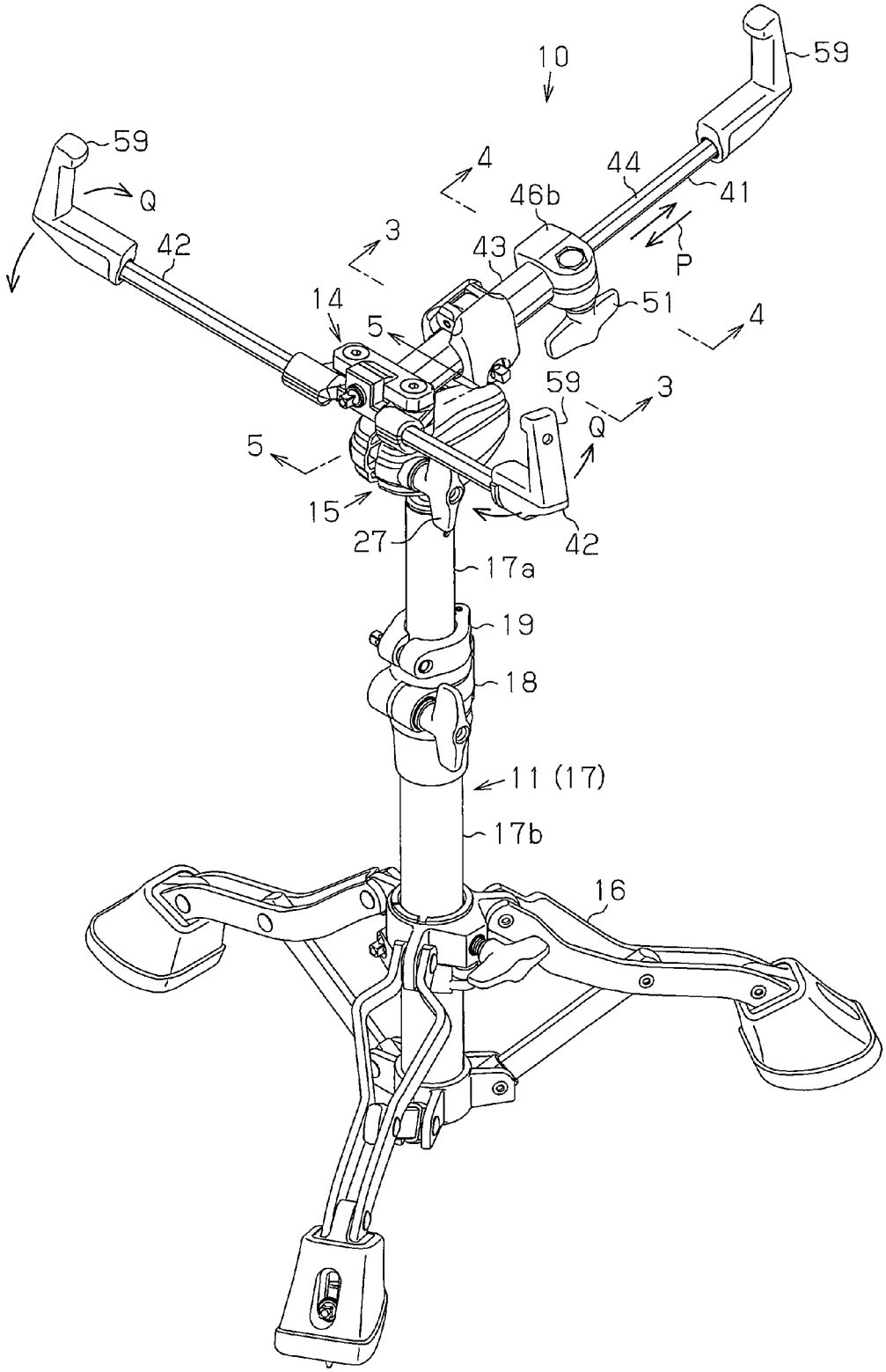
FIG. 1 is a perspective view showing a form when a drum stand according to the present invention is in use.
Figure 8:
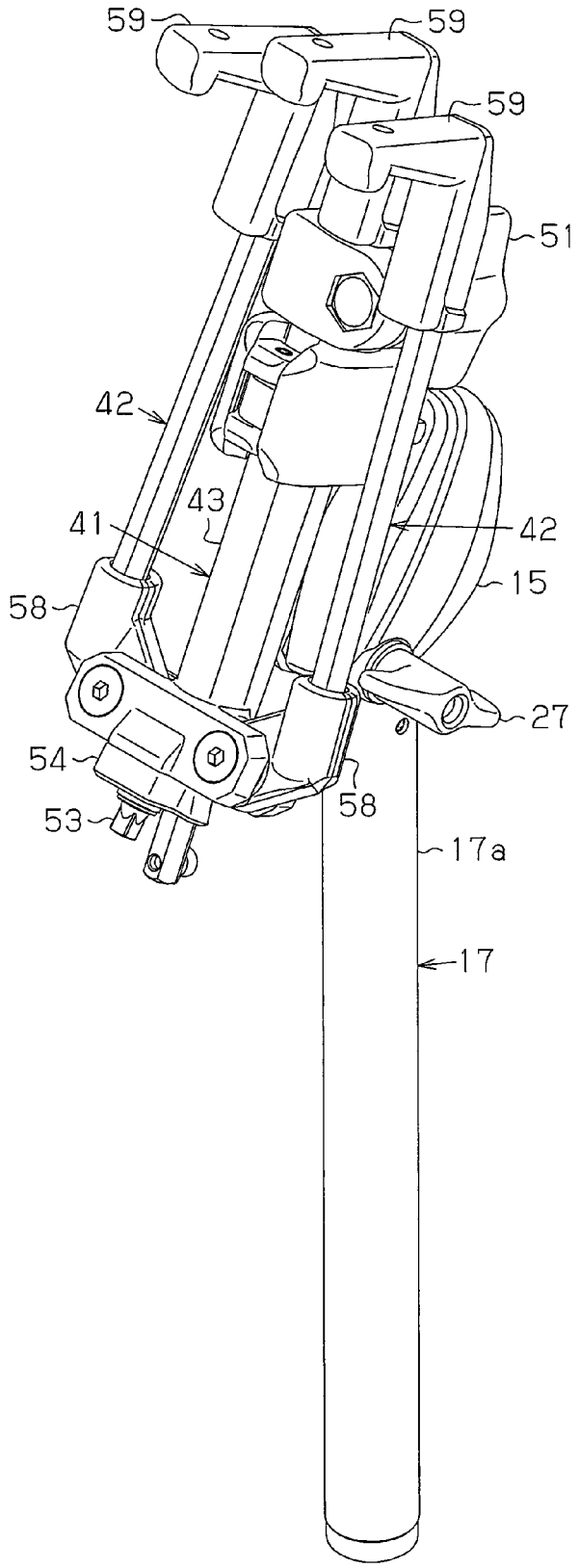
FIG. 8 is a perspective view showing a form when the drum stand is retracted.

As shown in FIG. 1, the drum stand 10 includes a stand main body 11, a drum support 14 having a plurality of arms, and an attachment 15 that attaches the drum support 14 to the stand main body 11. The drum support 14 is composed of a first arm 41, which is of a first type, and second and third arms 42, which are of a second type. The second and third arms 42 open and close with respect to the first arm 41. The drum support 14 can take a radially extended, in-use form, which is shown in FIG. 6C, and a retracted form, which is shown in FIG. 8.

The stand main body 11 includes a foldable tripod 16 and a post 17 extending upward from the center of the tripod 16. The post 17 includes an upper pipe 17*a* and a lower pipe 17*b*, which are different in diameter, and a pipe joint 18.

The pipe joint 18 selectively fixes the upper pipe 17*a* and the lower pipe 17*b* or permits them to slide with respect to one another. To the upper pipe 17*a*, a memory lock 19 is fitted to memorize a fixing position with the lower pipe 17*b*.

Figure 2:
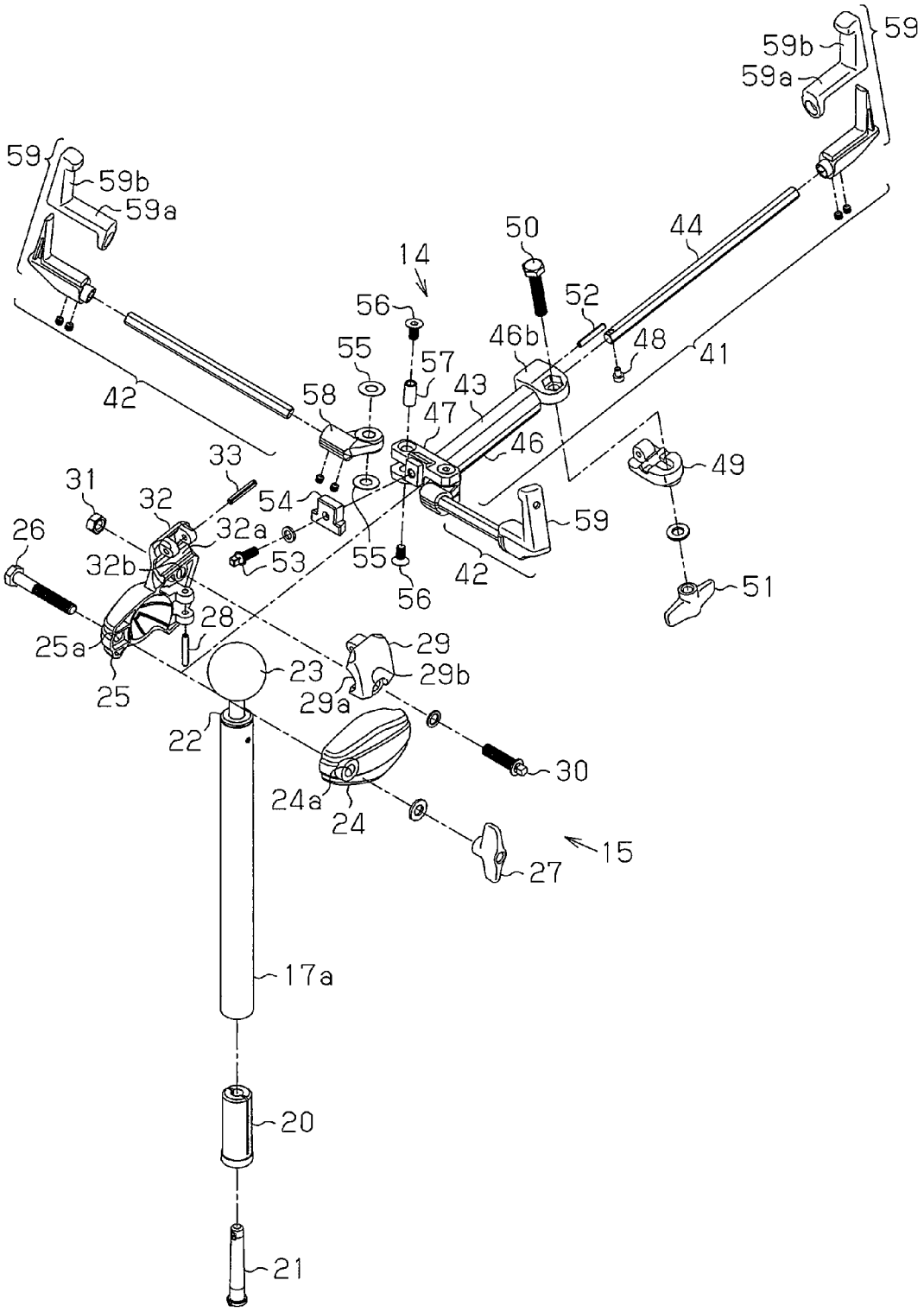
FIG. 2 is a perspective view of the drum stand.

As shown in FIG. 2, at the lower end of the upper pipe 17*a*, a cylindrical rubber member 20 is inserted. Also, inside the rubber member 20, a stopper 21 having a tapered outer peripheral surface is inserted. The rubber member 20 is fixed to the lower end of the upper pipe 17*a* by the stopper 21. To the upper opening end of the upper pipe 17*a*, a shaft member 22 is fitted. At the center of an upper surface of the shaft member 22, a spherical body 23 is fixed via a shaft.

The attachment 15 includes first and second clamp members 24 and 25, which are to be attached to the spherical body 23 on the shaft member 22, and a bolt 26 and a T-shaped nut 27, which fix the first and second clamp members 24 and 25. The first clamp member 24 is coupled to be pivotal with respect to an end portion of the second clamp member 25 via a pin 28. The first and second clamp members 24 and 25 have through-holes 24*a* and 25*a* at sides opposite to their coupling portion, respectively.

The bolt 26 is inserted through the through-holes 24*a* and 25*a* of the first and second clamp members 24 and 25 and then screwed in the T-shaped nut 27. By tightening the T-shaped nut 27, the first and second clamp members 24 and 25 sandwich the spherical body 23. Therefore, the attachment 15 is fixed to the upper pipe 17*a* via the shaft member 22. By loosening the T-shaped nut 27, gripping of the spherical body 23 by the first and second clamp members 24 and 25 is released. Therefore, the attachment 15 becomes pivotal with respect to the shaft member 22 and the upper pipe 17*a*. That is, the attachment 15 becomes pivotal forward and backward and leftward and rightward about the center of the spherical body 23.

Figure 3:
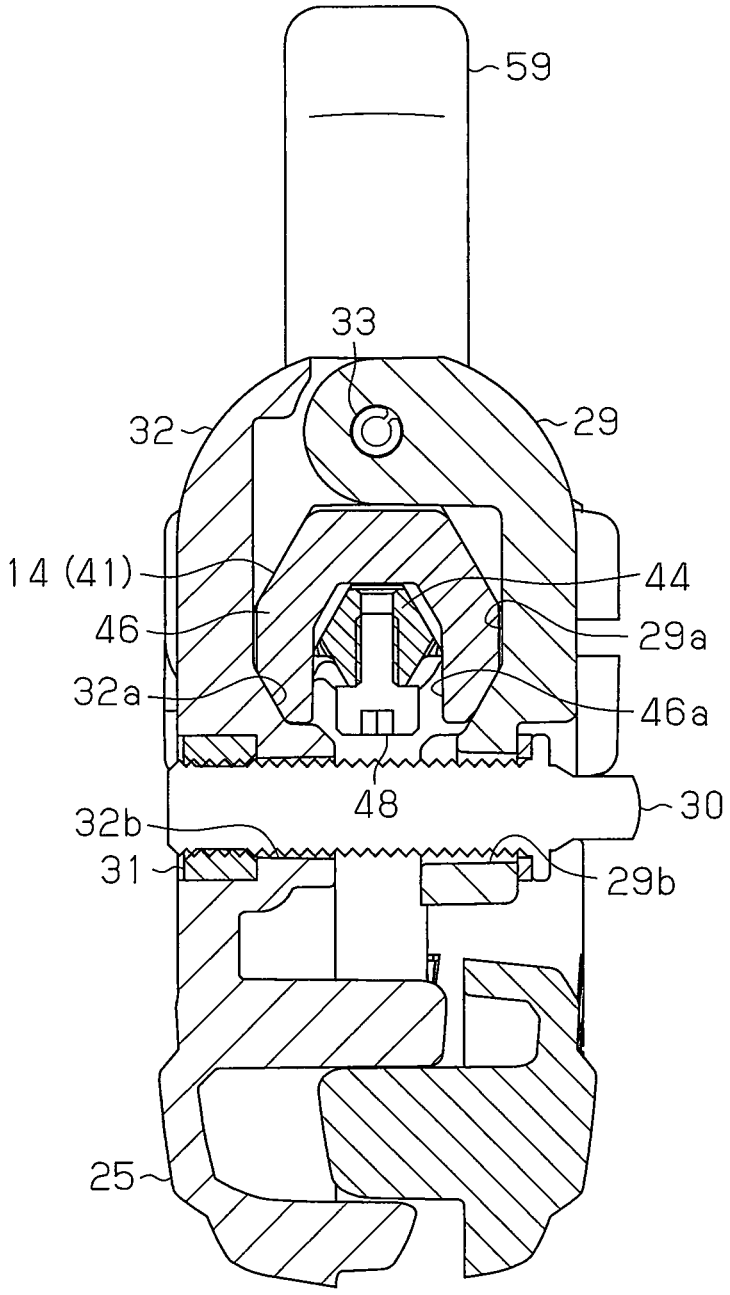
FIG. 3 is a sectional view along a line 3-3 of FIG. 1.

As shown in FIG. 2 and FIG. 3, the attachment 15 further includes a cover 29 to be attached to the second clamp member 25 from the side and a bolt 30 and a hexagon nut 31 that fix the cover 29 to the second clamp member 25. In the second clamp member 25, a support piece 32, which supports the drum support 14 together with the cover 29, is integrally formed. At inner surfaces of the support piece 32 and the cover 29, holding grooves 32*a* and 29*a*, which hold the drum support 14 and permit it to slide, are respectively formed.

The upper end of the cover 29 is coupled to be pivotal with respect to the support piece 32 of the second clamp member 25 via a coupling pin 33. At the lower ends of the support piece 32 and the cover 29, through-holes 32*b* and 29*b* are respectively formed. The bolt 30 is inserted through the through-holes 32*b* and 29*b* of the support piece 32 and the cover 29 and threaded to the hexagon nut 31. By tightening the bolt 30, the first arm 41 of the drum support 14 is gripped by the support piece 32 and the cover 29. Therefore, the drum support 14 is fixed to the attachment 15, so that the center position of the drum support 14 with respect to the axis of the post 17 is fixed. By loosening the bolt 30, gripping of the first arm 41 by the support piece 32 and the cover 29 is released. Therefore, the drum support 14 becomes slidable along the axis of the first arm 41 with respect to the attachment 15, so that the center position of the drum support 14 with respect to the axis of the post 17 is variable.

The first arm 41 includes a substantially T-shaped arm support 43 and a sliding arm 44 to be supported by the arm support 43. The arm support 43 includes a linear portion 46 extending along its axis and a base portion 47 in which the second and third arms 42 are coupled. The linear portion 46 has an octagonal shape in cross section. In the linear portion 46, a holding groove 46*a*, which accommodates the sliding arm 44 and permits the sliding arm 44 to slide, is formed. The holding groove 46*a* is opened downward and extends along the axis of the linear portion 46. Also, at the base end of the sliding arm 44, a stopper 48 is fixed.

As a result of the stopper 48 being brought into contact with the clamp piece 49, escape of the sliding arm 44 from the arm support 43 is prevented.

Figure 4:
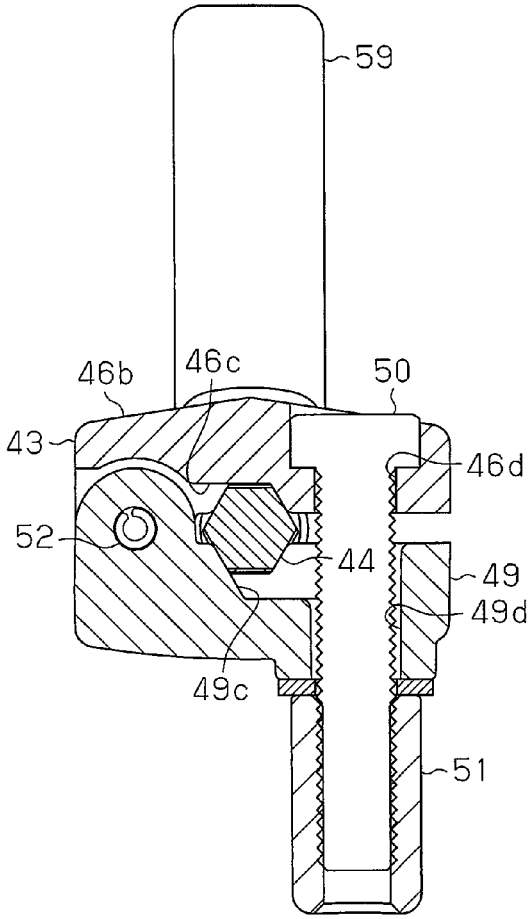
FIG. 4 is a sectional view along a line 4-4 of FIG. 1.

As shown in FIG. 2 and FIG. 4, the arm support 43 further includes a clamp piece 49 to be attached to the distal end of the linear portion 46 and a bolt 50 and a T-shaped nut 51 that fix the clamp piece 49 to the linear portion 46. At the distal end of the linear portion 46, a clamp portion 46*b* that supports the sliding arm 44 together with the clamp piece 49 is integrally formed. At inner surfaces of the clamp portion 46*b* and the clamp piece 49, holding grooves 46*c* and 49*c*, which hold the sliding arm 44 and permit it to slide, are respectively formed.

The clamp piece 49 is coupled to be pivotal with respect to the clamp portion 46*b* via a coupling pin 52. The clamp portion 46*b* and the clamp piece 49 have through-holes 46*d* and 49*d* at sides opposite to their coupling portion, respectively. The bolt 50 is inserted through the through-holes 46*d* and 49*d* of the clamp portion 46*b* and the clamp piece 49, and then screwed in the T-shaped nut 51. By tightening the T-shaped nut 51, the clamp portion 46*b* and the clamp piece 49 sandwich the sliding arm 44. Therefore, the sliding arm 44 is fixed to the arm support 43, so that the overall length of the first arm 41 is fixed. If the T-shaped nut 51 is loosened, gripping of the sliding arm 44 by the clamp portion 46*b* and the clamp piece 49 is released. Therefore, the sliding arm 44 can slide with respect to the arm support 43, so that the overall length of the first arm 41 is adjustable.

Figure 5:
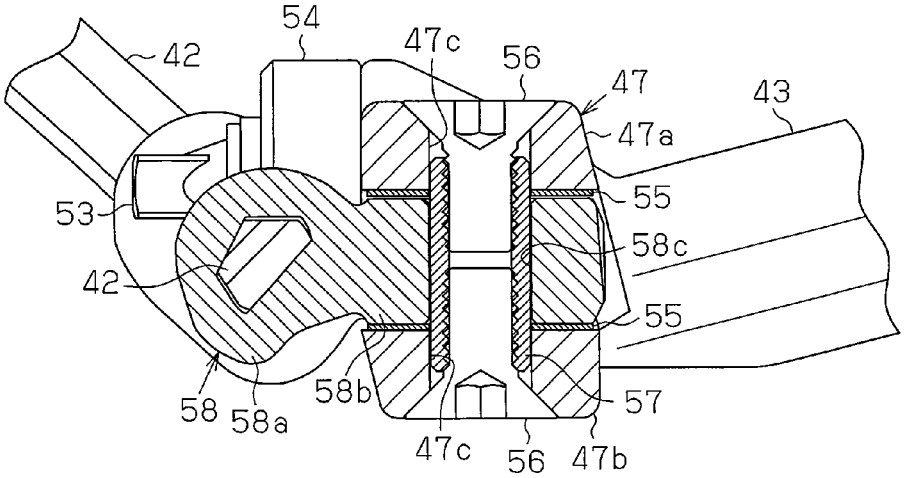
FIG. 5 is a sectional view along a line 5-5 of FIG. 1.

As shown in FIG. 2 and FIG. 5, the base portion 47 extends from the base end of the linear portion 46 in a direction perpendicular to the axis of the linear portion 46. At the center of the base portion 47, a T-shaped stopper 54 serving as a restricting member is attached by a bolt 53. At each end of the base portion 47, the second and third arms 42 are pivotally connected via resin washers 55, screws 56, a cylindrical nut 57, etc. At each end of the base portion 47, an upper wall 47*a* and a lower wall 47*b* are provided. In each of the upper wall 47*a* and the lower wall 47*b*, a vertical hole 47*c*, in which the head of the screw 56 and a part of the shank thereof are located, is formed.

Between the upper wall 47*a* and the lower wall 47*b*, an arm holder 58 is attached via the washers 55. The arm holder 58 includes a fixing portion 58*a* to which the second and third arms 42 are fixed and a coupling portion 58*b* which is coupled to the base portion 47. In the coupling portion 58*b*, a longitudinal hole 58*c* that is located coaxially with the vertical holes 47*c* of the upper wall 47*a* and the lower wall 47*b* is formed. The cylindrical nut 57 is fitted extending across the vertical hole 47*c* of the upper wall 47*a*, the vertical hole 58*c* of the coupling portion 58*b*, and the vertical hole 47*c* of the lower wall 47*b*. The screws 56 are screwed in the upper end and lower end of the cylindrical nut 57, respectively, in order to fix the cylindrical nut 57 to the longitudinal holes 47*c*, 58*c*, and 47*c*.

As shown in FIG. 2, at the distal ends of the arms 41 and 42, hooks 59 made of elastic members are attached. Each hook 59 is constructed by assembling two components that show a substantially L-shape. Each hook 59 includes a receiving portion 59*a* that receives a snare drum from below and a locking portion 59*b* that is locked on a lower hoop of the snare drum. The receiving portion 59*a* and the locking portion 59*b* are both formed in circular shapes in section in order to reduce the contact area with the snare drum.

Next, actions of the drum stand 10 described above will be described.

First, description will be given of a procedure when deforming the drum stand 10 from the in-use form shown in FIG. 1 into the retracted form shown in FIG. 8.

As shown in FIG. 1, first, the T-shaped nut 51 of the clamp portion 46*b* is loosened, and the sliding arm 44 is then slid in the P-direction of FIG. 1 with respect to the arm support 43 until the first arm 41 reaches the minimum length. Next, as shown by the arrows Q in FIG. 1, the second and third arms 42 are turned transversally until the second and third arms 42 become parallel to the first arm 41. Thus, the second and third arms 42 are closed with respect to the first arm 41, as shown in FIG. 8.

Subsequently, after loosening the T-shaped nut 27 of the attachment 15, the attachment 15 is tilted with respect to the post 17 until the arms 41 and 42 become parallel to the post 17. After the arms 41 and 42 are thus folded to extend along the post 17, the pipe joint 18 is operated to reduce the length of the post 17, and the tripod 16 is folded to extend along the post 17.

In the retracted form shown in FIG. 8, the first arm 41 has the minimum length and has been set equal to the overall length of the second and third arms 42. Also, the hooks 59 of the arms 41, 42 all face the same direction. In this manner, the drum stand 10 can be folded more compactly than a drum stand having curved portions at the distal ends of the arms. In addition, it suffices to perform operations to deform the drum stand 10 from the retracted form into the in-use form in a reverse order to the series of operations described above.

Subsequently, description will be given of a procedure when adjusting the diameter of the drum support 14 to correspond to a snare drum diameter.

Figure 6A:
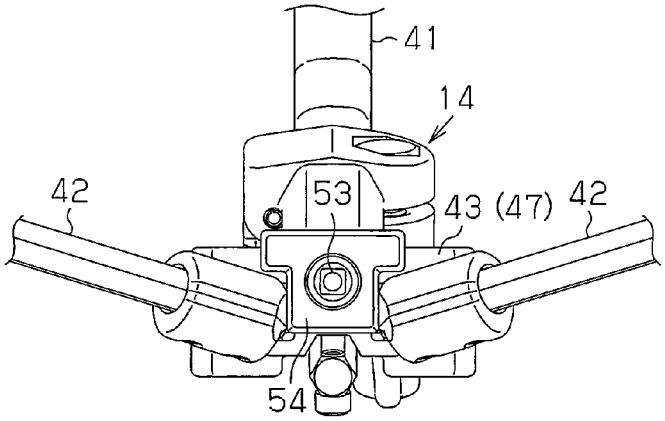
FIG. 6A is a partial front view showing the vicinity of a T-shaped stopper when supporting a 12-inch snare drum in an enlarged manner.
Figure 6B:
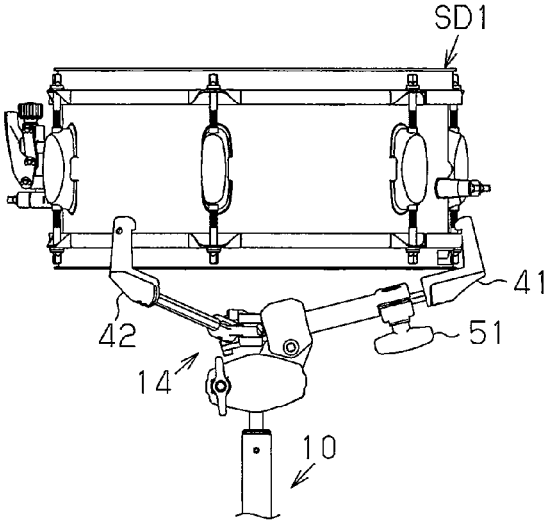
FIG. 6B is a side view of a snare drum when supporting a 12-inch snare drum.
Figure 6C:
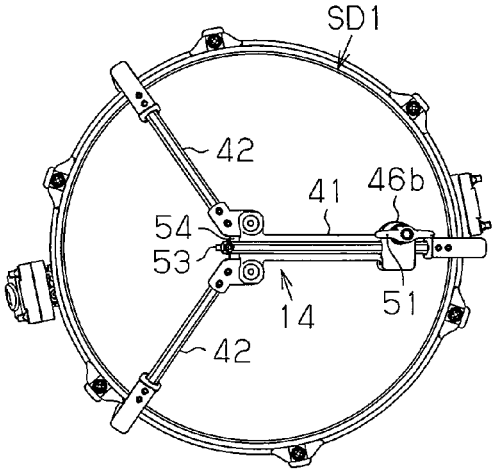
FIG. 6C is a bottom view of a drum support from below when supporting a 12-inch snare drum.
Figure 7A:
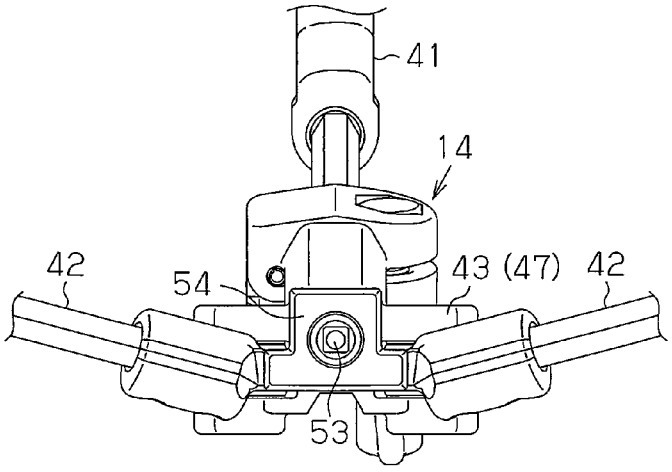
FIG. 7A is a partial front view showing the vicinity of a T-shaped stopper when supporting a 14-inch snare drum in an enlarged manner.
Figure 7B:
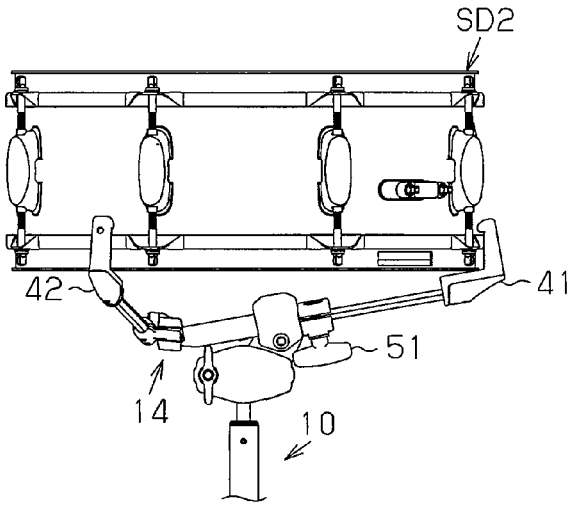
FIG. 7B is a side view of a snare drum when supporting a 14-inch snare drum.
Figure 7C:
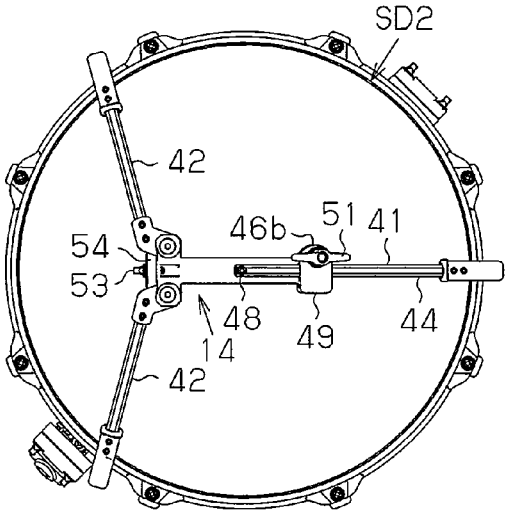
FIG. 7C is a bottom view of a drum support from below when supporting a 14-inch snare drum.

FIG. 6A and FIG. 6C show a drum stand 10 the diameter of the drum support 14 of which has been changed to correspond to a 12-inch diameter snare drum SD1. FIG. 7A to FIG. 7C show a drum stand 10 the diameter of the drum support 14 of which has been changed to correspond to a 14-inch diameter snare drum SD2.

In the case of the 12-inch diameter snare drum SD1, as shown in FIG. 6A, the T-shaped stopper 54 is located with a first orientation between the base ends of the second and third arms 42 and fixed to the bottom portion 47 of the arm support 43. Also, as shown in FIG. 6B, the arms 41 and 42 respectively extend obliquely and linearly from near the upper end of the post 17 toward a bottom surface of the snare drum SD1. In this case, the snare drum SD1 is supported by the arms 41 and 42, using the space between the arms 41 and 42. Also, as shown in FIG. 6C, the T-shaped stopper 54 prevents the two second and third arms 42 from closing from a first position in which they are opened at a first angle. In this case, the length of the first arm 41 is adjusted to be short to be substantially equal to the overall length of the second and third arms 42.

In the case of the 14-inch diameter snare drum SD2, as shown in FIG. 7A, the T-shaped stopper 54 is located with a second orientation between the base ends of the two second and third arms 42 and fixed to the bottom portion 47 of the arm support 43. Here, the second orientation is inverted vertically with respect to the first orientation. Also in this case, as shown in FIG. 7B, the arms 41 and 42 respectively extend from near the upper end of the post 17 toward a bottom surface of the snare drum SD2 at substantially the same angle as that in the case shown in FIG. 6B. Therefore, the snare drum SD2 is supported by the arms 41 and 42 at substantially the same height position as that in the case shown FIG. 6B. Also, as shown in FIG. 7*c*, the T-shaped stopper 54 prevents the two second and third arms 42 from closing from a second position at which they are opened at a second angle. Here, the second angle is set larger than the first angle. In this case, the length of the first arm 41 is adjusted, by operating the T-shaped nut 51 of the clamp portion 46*b*, to be longer than the overall length of the second arm 42.

Also, the drum stand 10 described above can hold a 13-inch diameter snare drum and a 15-inch diameter snare drum, respectively, based on the drum support 14 that corresponds to the 14-inch diameter snare drum SD2. In the case of a 13-inch diameter snare drum, it suffices to reduce the diameter of the drum support 14 to a size smaller than that in the case of the 14-inch diameter snare drum SD2 by shortening the length of the first arm 41 from that in the state shown in FIG. 7C. In this case, the sliding arm 44 is located more to the left than the position shown in FIG. 7C. On the other hand, in the case of a 15-inch diameter snare drum, it suffices to increase the diameter of the drum support 14 to a size larger than that in the case of the 14-inch diameter snare drum SD2 by extending the length of the first arm 41 from that shown in FIG. 7C. In this case, the sliding arm 44 is located further to the right than the position shown in FIG. 7C.

As is clear from FIG. 6B and FIG. 7B, the snare drum SD1, SD2 can be set at a lower position than that by a drum stand that turns the arms by stays to grasp a drum. Also, according to the drum stand 10, the diameter of the drum support 14 can be changed to correspond to the respective diameters of the two types of snare drums SD1 and SD2. In this case, the snare drums SD1 and SD2 can also be set at substantially the same height position regardless of the diameter of the snare drum SD1, SD2.

Thus, according to the present embodiment, the following effects can be obtained.

(1) The drum stand 10 includes a drum support 14 having a plurality of arms. The drum support 14 includes a first arm 41, which is of a first type, and second and third arms 42 of a second type, which open and close with respect to the first arm 41. The arms 41 and 42 all extend obliquely and linearly from near the upper end of the post 17 toward the bottom surface of the snare drum SD1. According to this arrangement, setting the extending direction of the first and second arms 41 and 42 to be oblique with respect to the bottom surface of the snare drum SD1, SD2 allows space to be provided between the first and second arms 41 and 42 and the bottom surface of the snare drum SD1, SD2. Therefore, in an in-use form, the snare drum SD1, SD2 is supported by the arms 41 and 42 using the space between the arms 41 and 42 extending from near the upper end of the post 17. Accordingly, the snare drum SD1, SD2 can be set at a lower position than that by a drum stand that turns the arms by stays to grasp the drum. Also, the first and second arms 41 and 42 all extend linearly and have no curved portions. Therefore, in a retracted form, the first and second arms 41 and 42 are parallel with the post 17 throughout their overall lengths. Accordingly, as compared with a drum stand having curved portions at the distal ends of the arms, the drum stand 10 is compact in its retracted form.

(2) The drum support 14 is composed of a first arm 41 of a first type and second and third arms 42 of a second type, which open and close with respect to the first arm 41. Setting the total number of arms to three limits the number of arms to the minimum number necessary for stable support of the snare drum SD1, SD2. In their retracted form, the arms 41 and 42 are more compact, which allows the drum stand 10 to be more compact when retracted, or folded.

(3) If the T-shaped nut 51 of the arm support 43 is loosened, gripping of the sliding arm 44 by the clamp portion 46*b* and the clamp piece 49 is released. Therefore, the sliding arm 44 can slide with respect to the arm support 43, so that the overall length of the first arm 41 becomes adjustable. According to this arrangement, simply sliding the sliding arm 44 along the axis of the arm support 43 allows the length of the first arm 41 to be adjusted. Also, adjusting the length of the first arm 41 in an in-use form allows changing the diameter of a circle that includes the distal ends of the radially opened arms 41 and 42. In this manner, simply adjusting the length of the first arm 41 allows adjusting the diameter of the drum support 14 to correspond to the diameter of the snare drum SD1, SD2.

(4) In a retracted form, the first arm 41 has the minimum length and has been set equal to the overall length of the second and third arms 42. According to this arrangement, the arms 41 and 42 in a retracted form can be made still more compact, which allows the drum stand 10 to be still more compact in its retracted, or folded form.

(5) By loosening the hexagon nut 31 of the attachment 15, gripping of the drum support 14 by the support piece 32 and the cover 29 is released. Therefore, the drum support 14 can slide along the axis of the first arm 41 with respect to the attachment 15, so that the center position of the drum support 14 with respect to the axis of the post 17 becomes variable. According to this arrangement, the drum support 14 can be moved along the axis of the first arm 41 by operating the attachment 15 as described above. The center of the snare drum SD1, SD2 fitted to the drum support 14 can thereby be located at the same position as that of the post 17 of the stand main body 11. Accordingly, the snare drum SD1, SD2 can be stably supported by the drum stand 10.

(6) At the center of the base portion 47, a T-shaped stopper 54 is attached. According to this arrangement, locating the T-shaped stopper 54 with a first orientation between the base ends of the two second and third arms 42 prevents the second and third arms 42 from closing from a first position at which they are opened at a first angle. In this case, the diameter of the drum support 14 can be adjusted to correspond to the snare drum SD1 having a relatively small diameter. On the other hand, locating the T-shaped stopper 54 with a second orientation between the base ends of the two second arms 42 prevents the two second arms 42 from closing from a second position at which they are opened at a second angle. In this case, the diameter of the drum support 14 can be adjusted to correspond to the snare drum SD2 having a relatively large diameter. Here, the second orientation is vertically inverted with respect to the first orientation. That is, simply inverting the position of the T-shaped stopper 54 on the base portion 47 adjusts the diameter of the drum support 14 to correspond to the diameters of the two types of snare drums SD1 and SD2. Accordingly, the diameter of the drum stand 14 can be easily switched to correspond to the type of the snare drum SD1, SD2 to be attached to the drum stand 10.

(7) By loosening the T-shaped nut 27 of the attachment 15, gripping of the spherical body 23 by the first and second clamp members 24 and 25 is released. Therefore, the attachment 15 becomes pivotal with respect to the upper pipe 17*a* via the shaft member 22. In this manner, tilting the attachment 15 with respect to the post 17 allows the arms 41 and 42 to be folded until they become parallel to the post 17. This allows the drum stand 10 to be folded into a more compact, retracted form. Also, the attachment 15 is pivotal in front and rear, left and right, and up and down directions about the center of the spherical body 23. Therefore, changing the attaching angle of the drum support 14 with respect to the post 17 also allows adjusting the top head angle of the snare drum SD1, SD2 to an easy to play angle.

(8) Each hook 59 includes a receiving portion 59*a* that receives a snare drum from below and a locking portion 59*b* that is locked on a lower hoop. The receiving portion 59*a* and the locking portion 59*b* are both formed in circular shapes in cross section in order to reduce the contact area with the snare drum. According to this arrangement, the hook 59 minimizes the contact area with the hoop, shell, etc., while grasping the snare drum SD1, SD2. In this case, because vibration of the snare drum SD1, SD2 is not easily cancelled by the hook 59, drum sounds are permitted to sufficiently resonate.

In addition, the present embodiment may be modified as follows:

In the present embodiment, the drum support 14 is attached to the upper pipe 17*a* of the stand main body 11 by using the attachment 15. Alternatively, the drum stand 14 may be directly attached to the upper pipe 17*a* of the stand main body 11 without using the attachment 15. In this case, the drum support 14 has a built-in tilter function.

In the present embodiment, the drum support 14 is composed of a first arm 41, of a first type, and second and third arms 42 of a second type, which open and close with respect to the first arm 41. Alternatively, the number of the second type of arms 42 may be three or more.

In the present embodiment, the first arm 41 includes an arm support 43 and a sliding arm 44 to be supported by the arm support 43. Alternatively, the first arm 41 may be composed of a single member.

In the present embodiment, clamping structures are used as the structure for fixing the attachment 15 to the upper pipe 17*a*, the structure for fixing the drum support 14 to the attachment 15, and the structure for fixing the sliding arm 44 to the arm support 43. Alternatively, for example, structures for directly fixing movable members to fixed members by use of bolts may be adopted.

In the present embodiment, the T-shaped stopper 54 is used as a restricting member that prevents the two second arms 42 from closing from the first position at which they are opened at the first angle or the second position at which they are opened at the second angle. Alternatively, two types of restricting members may be prepared, and the two types of restricting members may be replaced with each other to correspond to the diameter of the snare drum SD1, SD2 to be fitted to the drum stand 10. Also, the T-shaped stopper 54 may be omitted from the drum stand 10.

In the present embodiment, the drum stand 10 is embodied into a snare drum stand, but the drum stand 10 may be embodied into a tom stand.

The invention claimed is:

1. A drum stand including a stand main body having a post and a drum support, wherein the drum support includes a plurality of arms that support a drum, and the arms are able to take an in-use form, in which the arms are radially opened from a location near an upper end of the post, and a retracted form, into which the arms pivot to be closed from the in-use form and folded to extend along the post, wherein the plurality of arms comprises:

a first arm, which is an arm of a first type, is provided near an upper end of the post; and at least one second arm, which is an arm of a second type, is provided near the upper end of the post and pivots to open and close with respect to the first arm, the first and second arms respectively extend obliquely toward a bottom surface of the drum, and the first and second arms respectively extend in a linear manner between a corresponding one of proximal ends of the arms and a corresponding one of distal ends of the arms and have no bend between the corresponding one of the proximal ends of the arms and the corresponding one of the distal ends of the arms.

2. The drum stand according to claim 1, wherein the plurality of arms consists of the first arm, the second arm, and a third arm, wherein the third arm is an arm of the second type.

3. The drum stand according to claim 1, wherein the first arm is adjustable in length.

4. The drum stand according to claim 3, wherein the first arm includes an arm support, which has a longitudinal axis and is provided at the upper end of the post, and a sliding arm, which is supported by the arm support and is adapted to slide along the longitudinal axis of the arm support.

5. The drum stand according to claim 3, wherein the first arm has a minimum length, which is substantially equal to a length of the second arm.

6. The drum stand according to claim 1, wherein the drum support further includes an attachment for attaching the drum support to the upper end of the post, and the attachment supports the drum support to be movable along an axis of the first arm.

7. The drum stand according to claim 2, wherein the drum support further includes a restricting member that prevents the second and third arms from closing from a first position, at which the second and third arms are opened at a first angle, or from a second position, at which the second arms are opened at a second angle, wherein the second angle is larger than the first angle.

8. The drum stand according to claim 7, wherein the restricting member consists of a T-shaped stopper, by arranging the T-shaped stopper in a first orientation between base ends of the two second arms, the two second arms are prevented from closing from the first opening position, and by arranging the T-shaped stopper in a second orientation between base ends of the two second arms, the two second arms are prevented from closing from the second opening position.

9. The drum stand according to claim 6, wherein the attachment is held to be pivotal with respect to the upper end of the support.

10. The drum stand according to claim 1, wherein a hook for engaging the drum is provided at a distal end of each of the arms, and a part of the hook opposed to the drum has a circular shape in cross section.

* * * * *